US007770421B2

(12) United States Patent
Yu

(10) Patent No.: US 7,770,421 B2
(45) **Date of Patent: *Aug. 10, 2010**

(54) PADLOCK WITH INDICATION DEVICE

(76) Inventor: Chun Te Yu, No. 253, Sec. 3, Yanhai Rd., Fusing Township, Changhua County 506 (TW)

( * ) Notice: Subject to any disclaimer, the term of this patent is extended or adjusted under 35 U.S.C. 154(b) by 0 days.

This patent is subject to a terminal disclaimer.

(21) Appl. No.: 11/491,258

(22) Filed: Jul. 24, 2006

(65) Prior Publication Data

US 2006/0254325 A1 Nov. 16, 2006

Related U.S. Application Data

(63) Continuation-in-part of application No. 11/032,116, filed on Jan. 11, 2005, now Pat. No. 7,100,401.

(51) Int. Cl.
*E05B 37/02* (2006.01)

(52) U.S. Cl. ..... 70/21; 70/25; 70/432

(58) Field of Classification Search ..... 70/20–49, 70/432, 439–441, 335, 16, 437, 284–285, 70/435

See application file for complete search history.

(56) References Cited

U.S. PATENT DOCUMENTS

| | | | | |
|---|---|---|---|---|
| 972,171 | A | 10/1910 | Dupont | |
| 3,808,848 | A | 5/1974 | Yang | |
| 3,837,189 | A | 9/1974 | Atkinson | |
| 6,877,345 | B1 * | 4/2005 | Misner et al. | 70/25 |
| 7,007,521 | B1 | 3/2006 | Misner et al. | |
| 7,047,773 | B1 | 5/2006 | Lin | |
| 7,140,209 | B2 * | 11/2006 | Lai | 70/25 |
| 2002/0088256 | A1 * | 7/2002 | Taylor et al. | 70/25 |
| 2004/0226323 | A1 | 11/2004 | Ling et al. | |
| 2004/0226324 | A1 * | 11/2004 | Loughlin et al. | 70/25 |
| 2005/0092036 | A1 | 5/2005 | Lai | |
| 2005/0235706 | A1 * | 10/2005 | Ling et al. | 70/29 |
| 2005/0262902 | A1 * | 12/2005 | Ling et al. | 70/21 |
| 2005/0262903 | A1 | 12/2005 | Ling et al. | |

* cited by examiner

*Primary Examiner*—Peter M Cuomo
*Assistant Examiner*—Kristina R Fulton
(74) *Attorney, Agent, or Firm*—Rosenberg, Klein & Lee

(57) ABSTRACT

A padlock comprising a housing, a shackle, a lock mechanism and a movable block. The shackle is mounted on the housing and has a first end formed with a shaft portion movably mounted in the housing, and a second end formed with a locking portion moved with the shaft portion and extended outward from the housing. The lock mechanism is mounted on the housing, and includes a lock core and a limit knob. The lock core is mounted in the housing, and the limit knob is located outside the housing and movable by the lock core so as to engage or disengage with the locking portion of the shackle. The movable block is connected to the limit knob of the lock mechanism so that the movable block can be moved to an indication position by operating the lock core of the lock mechanism.

9 Claims, 12 Drawing Sheets

PADLOCK WITH INDICATION DEVICE

CROSS REFERENCE TO RELATED APPLICATION

This is a continuation-in-part application of Ser. No. 11/032,116 filed Jan. 11, 2005, now U.S. Pat. No. 7,100,401, issued on Sep. 5, 2006.

BACKGROUND OF INVENTION

1. Field of Invention

The present invention relates to a padlock, and more particularly to a padlock with an indication device for reminding a padlock owner whose padlock has been operated or used and luggage may have been inspected by the customs.

2. Description of Related Art

A conventional dual lock or padlock generally includes a shell, a shackle installed on the shell, a first locking mechanism installed on the shell to lock and unlock the shackle, and a second locking mechanism installed on the shell to lock and unlock the shackle. The first locking mechanism can only be unlocked by a padlock owner while the second locking mechanism can be unlocked only by a specific key. The specified key is often held by a customs inspector who is authorized to unlock the second locking mechanism of the padlock when it is necessary to open and check a luggage, a case or a bag subject to the lock or padlock without breaking it. Then, the inspector can re-lock the lock or padlock via the second locking mechanism by the specified key after inspecting the luggage, case or bag. However, an owner of such a luggage, case or bag cannot judge by the appearance of the lock or padlock if the lock or padlock has been operated or used and the luggage, case or bag has been checked that would cause great inconvenience to the owner.

SUMMARY OF INVENTION

The primary objective of the present invention is to provide a padlock capable of reminding a padlock owner whose padlock has been operated or used and luggage may have been inspected by the customs.

In one embodiment of the present invention, a padlock comprises a housing, a shackle, a lock mechanism and a movable block. The housing defines an opening at a wall thereof to communicate an interior space of the housing and the outside of the housing. The shackle is mounted on the housing and has a first end formed with a shaft portion movably mounted in the housing, and a second end formed with a locking portion moved with the shaft portion and extended from the shaft portion. The lock mechanism is mounted on the housing, and includes a lock core and a limit knob. The lock core is mounted in the housing. The limit knob comprises a driving member and a button. The driving member is displaceable within the interior space of the housing via the opening. The button is coupled to the driving member and located outside of the housing. The driving member is displaceable by the lock core so as to drive the button to engage or disengage with the locking portion of the shackle. The movable block is is disposed in the opening of the housing and capable of moving along a surface of the driving member from the opening of the housing to an indication position outside of the housing by operating the lock core of the lock mechanism.

Further benefits and advantages of the present invention will become apparent after a careful study of the detailed description with reference to the accompanying drawings.

DETAILED DESCRIPTION OF INVENTION

FIGS. 1-10 show a padlock as a first embodiment of the present invention. As shown in FIGS. 1-5, the padlock comprises a housing 1, a shackle 2, a lock mechanism 4, and a movable block 5. The lock mechanism 4 can be a key lock mechanism or a number lock mechanism. In the present invention, the lock mechanism 4 is preferably the key lock mechanism.

Figure 8:
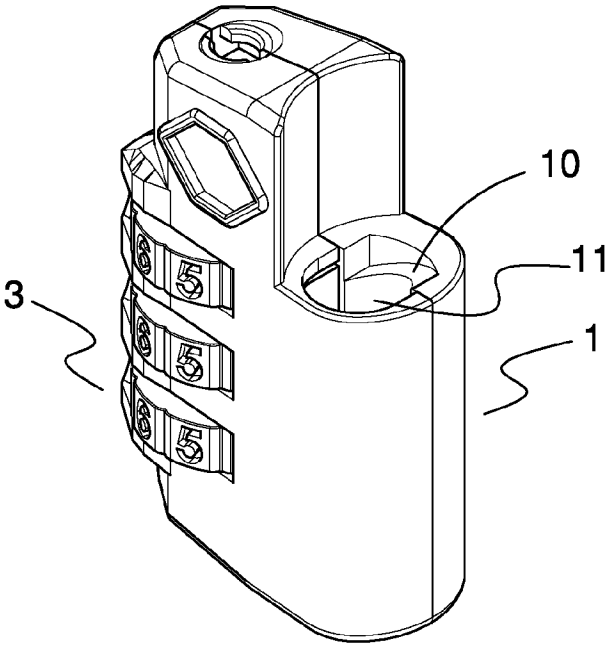
FIG. 8 is a perspective partial view of the padlock shown in FIG. 1.

In the first embodiment, the housing 1 defines an opening 11, as can be seen in FIG. 8, in a wall thereof to communicate an interior space of the housing 1 and the outside of the housing 1. The shackle 2 is substantially U-shaped and mounted on the housing 1. The shackle 2 includes a first end formed with a shaft portion 20 movably mounted in the housing 1, and a second end formed with a locking portion 21 moved with the shaft portion 20 and extended from the shaft portion 20.

The lock mechanism 4 is mounted on the housing 1, and includes a lock core 41 and a limit knob 40. The lock core 41 is mounted in the housing. The limit knob 40 comprises a driving member 404 and a button 405. The driving member 404 is displaceable within the interior space of the housing 1 via the opening 11 of the housing 1. The button 405 is coupled to the driving member 404 and located outside of the housing 1. The driving member 404 is displaceable by the lock core 41 so as to drive the button 405 to engage or disengage with the locking portion 21 of the shackle 2. Additionally, the button 405 of the limit knob 40 includes a top face formed with a recess 400 for receiving an end 210 of the locking portion 21 of the shackle 2. The recess 400 includes an open end at a periphery of the limit knob 40.

Furthermore, the movable block 5 is disposed within the opening 11 of the housing 1 and is capable of moving along a surface of the driving member 404 from the opening 11 of the housing 1 to an indication position outside of the housing 1 by operating the lock core 41 of the lock mechanism 4, as shown in FIGS. 5-10.

Figure 4:
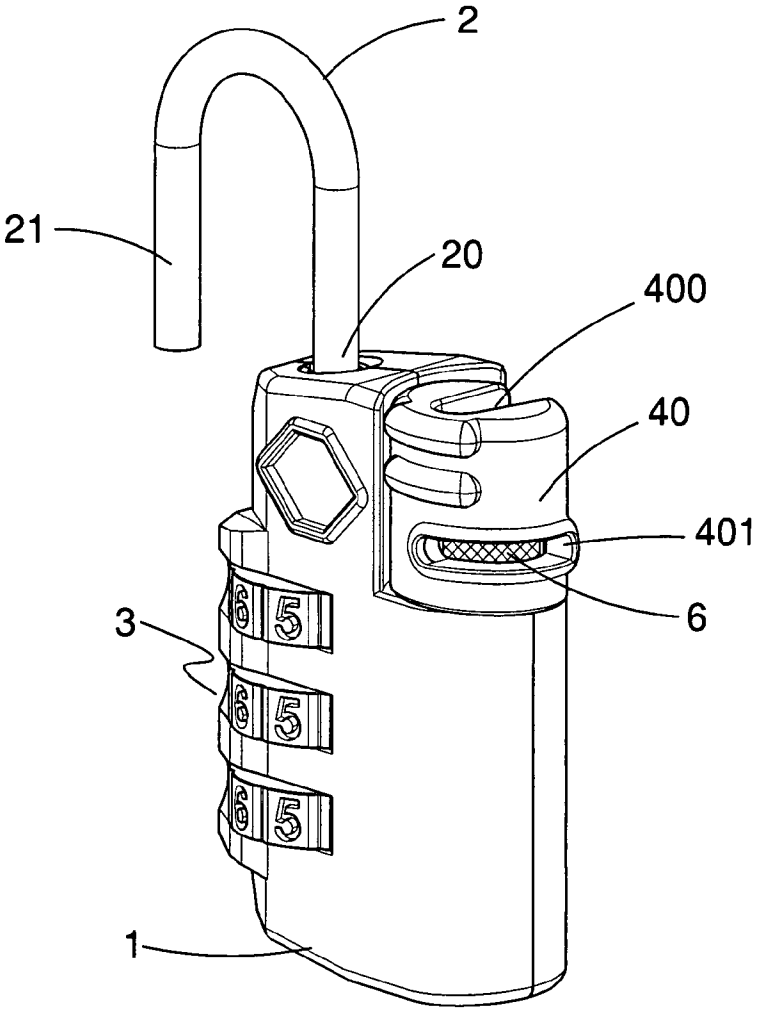
FIG. 4 is a perspective view of the padlock in another position than that is shown in FIG. 3.
Figure 6:
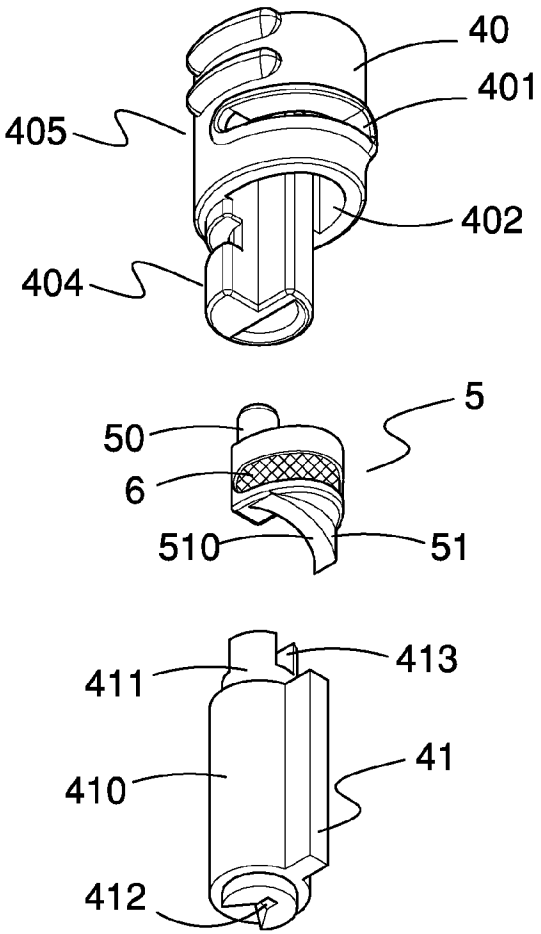
FIG. 6 is another exploded partial view of the padlock shown in FIG. 1.
Figure 5:
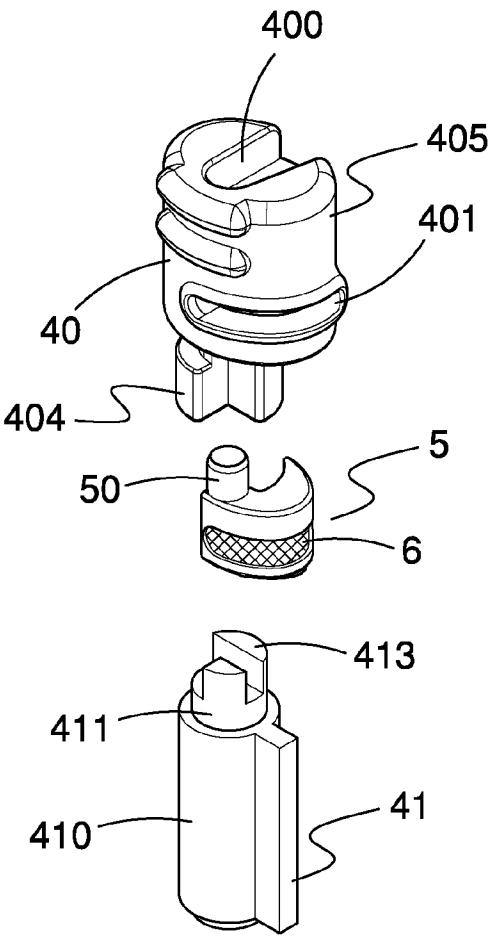
FIG. 5 is an exploded partial view of the padlock shown in FIG. 1.

FIGS. 4-6 show that the padlock further comprises an indication member 6 provided on the movable block 5. The button 405 of the limit knob 40 defines a window 401 in the periphery. In the first embodiment, the indication member 6 is visible from the window 401 of the button 405 when the movable block 5 is located in the indication position.

As described above, the lock mechanism 4 is preferably the key lock mechanism. Accordingly, the lock core 41 of the lock mechanism 41 comprises a body 410 and a rotor 411. The rotor 411 is movably received in the body 410, and has one end defining a keyhole portion 412, and the other end defining a driving portion 413 extending from the body 410 for connecting with the limit knob 40. The keyhole portion 412 of the rotor 411 is arranged for receiving a matching key (not shown). When the matching key is inserted into the keyhole portion 412, the driving portion 413 can correspondingly drive the limit knob 40 to move.

In addition, the padlock of the present invention further comprises a number lock unit 3, which is mounted in the housing 1 for locking and unlocking the shaft portion 20 of the shackle 2, as shown in FIGS. 1-4.

Figure 2:
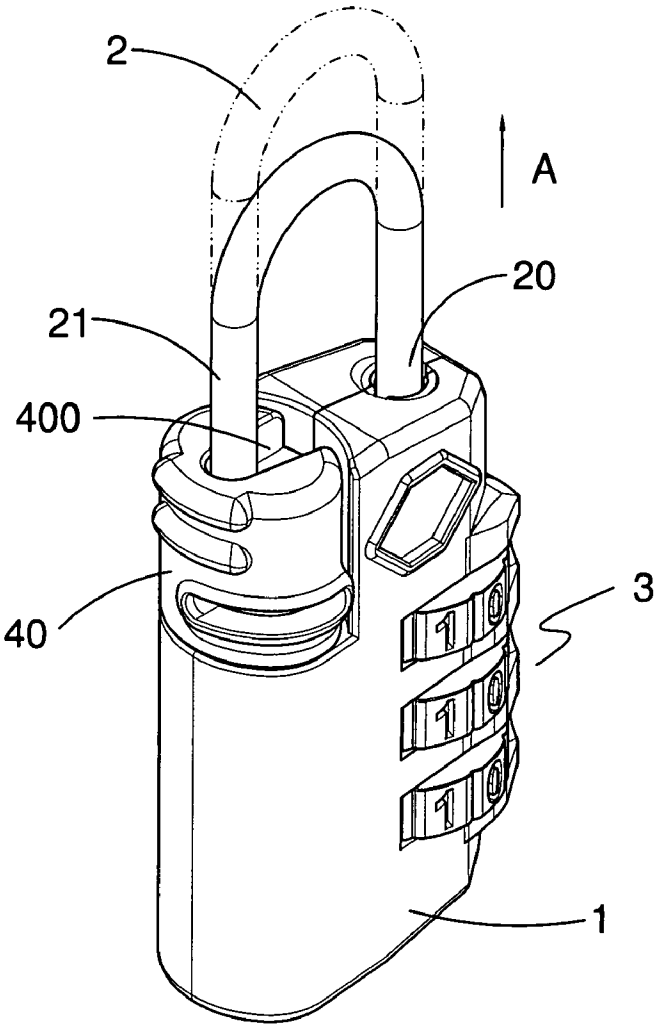
FIG. 2 is a perspective view of the padlock shown in FIG. 1.
Figure 1:
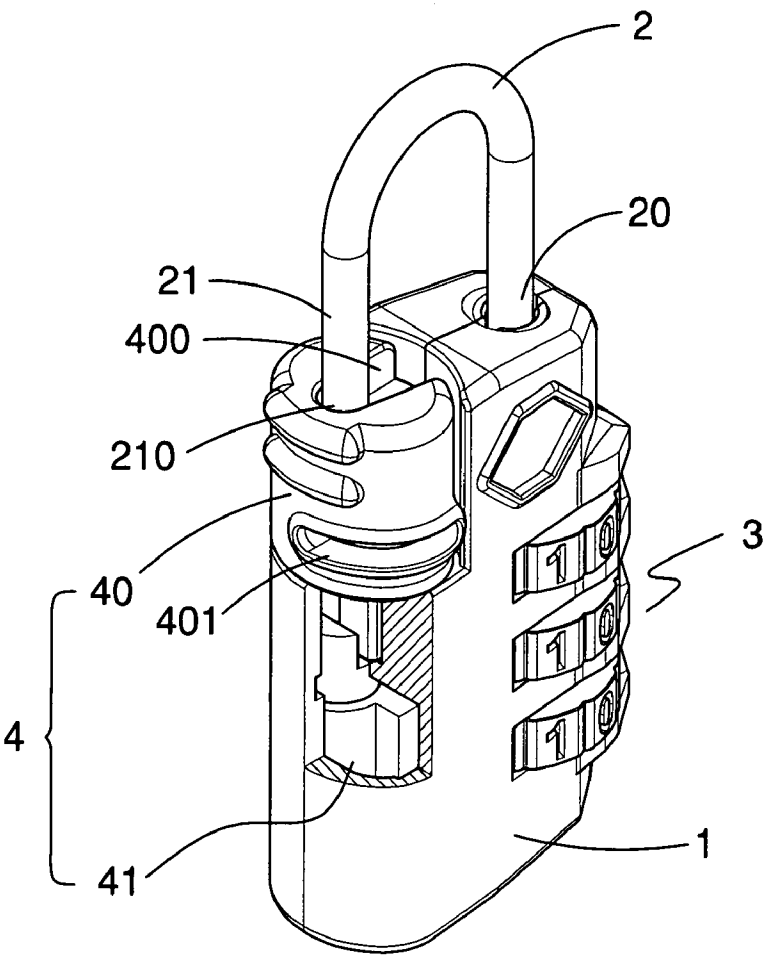
FIG. 1 is a cutaway view of a padlock in accordance with a first embodiment of the present invention.

FIG. 2 shows that the open end of the recess 400 of the limit knob 40 is directed toward and sealed by the housing 1, and the locking portion 21 of the shackle 2 is extended into and stopped by the recess 400 of the limit knob 40 of the lock mechanism 4. That is, the shackle 2 is stopped by the limit knob 40, thus forming a locked state. When the number lock unit 3 is unlocked, the shaft portion 20 of the shackle 2 is unlocked from the number lock unit 3 so that the shackle 2 is movable in a direction indicated by an arrow head A, so as to detach the locking portion 21 of the shackle 2 from the recess 400 of the limit knob 40 of the lock mechanism 4, thereby forming an unlocked state.

Figure 3:
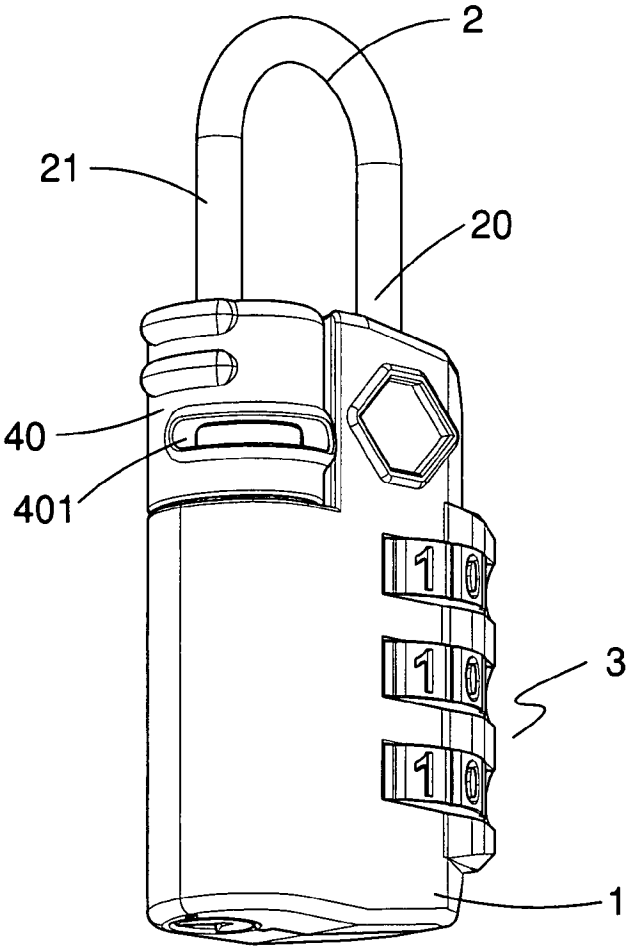
FIG. 3 is another perspective view of the padlock shown in FIG. 1.

Referring to FIG. 3, when the number lock unit 3 is locked, the shaft portion 20 of the shackle 2 is locked by the number lock unit 3. That is, the locking portion 21 of the shackle 2 is stopped by the limit knob 40, thereby forming a locked state.

In FIG. 4, when the limit knob 40 of the lock mechanism 4 is moved by the lock core 41 via the matching key, the open end of the recess 400 of the limit knob 40 is released from the housing 1. Accordingly, the locking portion 21 of the shackle 2 is released from the recess 400 of the limit knob 40 and can be rotated about the shaft portion 20 of the shackle 2, thereby forming an unlocked state.

FIG. 5 shows that the movable block 5 is movably mounted on the driving member 404 of the limit knob 40 of the lock mechanism 4 and includes a first side provided with a shaft 50 directed toward the limit knob 40. The indication member 6 is provided on the movable block 5 and is visible from the window 401 of the limit knob 40 when the movable block 5 is located in the indication position. Preferably, the indication member 6 is a color, character, number or pattern. For examples, the indication member 6 is printed in red, and the movable block 5 is printed in green. Hence, the red of the indication member 6 visible from the window 401 presents the lock core 41 of the lock mechanism 4 is operated or used.

Figure 7:
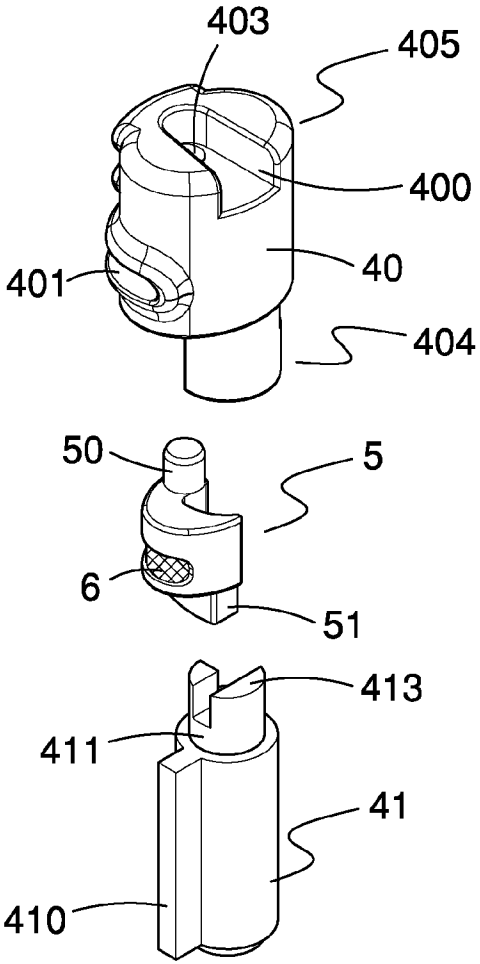
FIG. 7 is an exploded partial view of the padlock in another position than that is shown in FIG. 5.

Furthermore, FIGS. 6-8 show that the button 405 of the limit knob 40 is formed with a chamber 402 facing the housing 1 for receiving the movable block 5. The movable block 5 includes a second side provided with a guide portion 51 formed with a first ramp 510. The recess 400 of the limit knob 40 includes an aperture 403 in communication with the chamber 402. The shaft 50 of the movable block 5 can be inserted into the aperture 403 of the limit knob 40. Additionally, the housing 1 is formed with a second ramp 10 complementarily touchable with the first ramp 510 of the guide portion 51 of the movable block 5.

Figure 10:
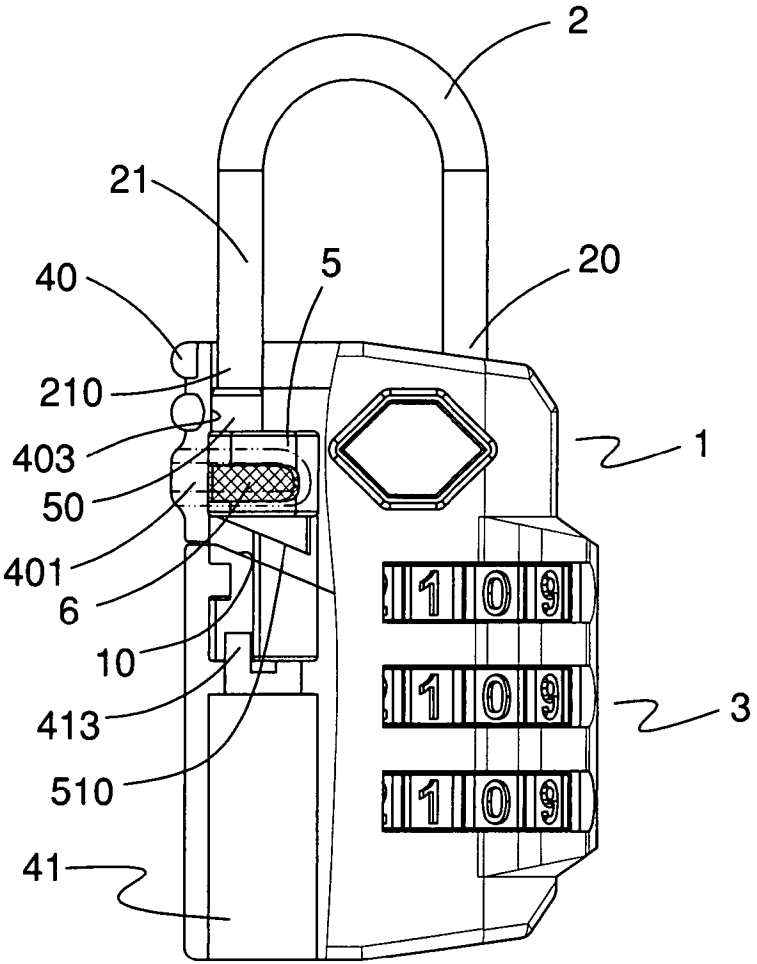
FIG. 10 is a side view of the padlock in another position than that is shown in FIG. 9.
Figure 9:
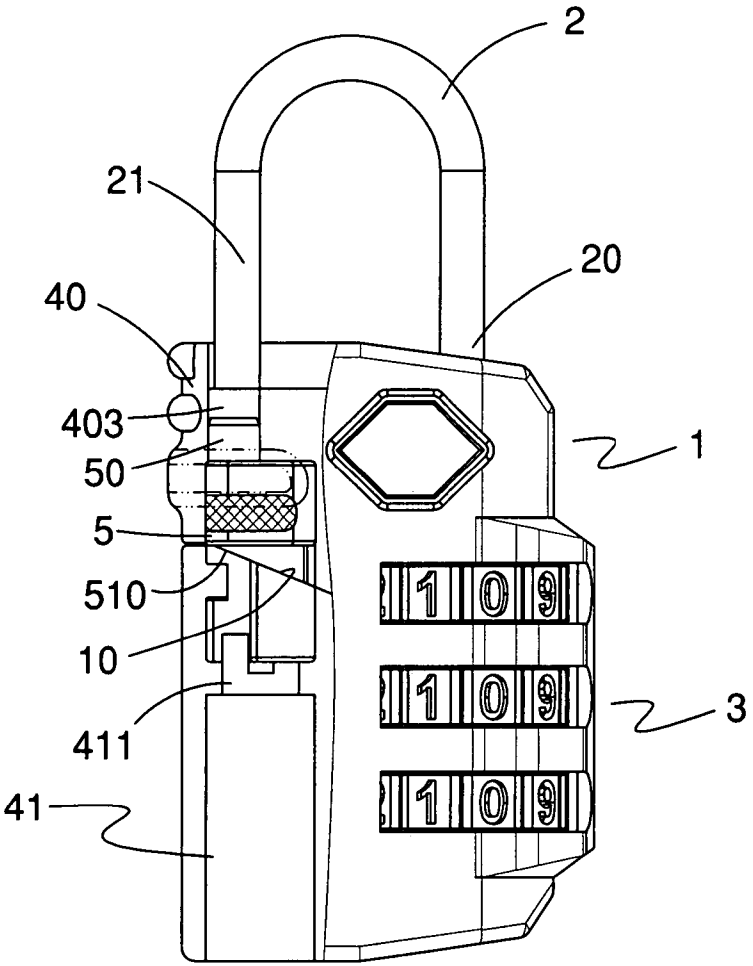
FIG. 9 is a side view of the padlock shown in FIG. 1.

Referring to FIG. 9, the first ramp 510 of the movable block 5 and the second ramp 10 of the housing 1 complementarily touch each other so that the indication member 6 is hidden in the housing 1 and detached from the window 401 of the limit knob 40, which indicates that the lock mechanism 4 is not been operated or used. In FIG. 10, when the driving portion 413 of the rotor 411 of the lock mechanism 4 is rotated by the matching key, the limit knob 40 is rotated accordingly until the open end of the recess 400 of the limit knob 40 is released from the housing 1. Therefore, the locking portion 21 of the shackle 2 is released from the recess 400 of the limit knob 40 and is rotated freely about the shaft portion 20 of the shackle 2 to the unlocked state. At the time, the shaft 50 of the movable block 5 is moved further to extend into the aperture 403 of the limit knob 40 so that when the limit knob 40 is rotated by the lock core 41, the movable block 5 is driven by the limit knob 40. In such a manner, the movable block 5 is lifted to the indication position by engagement between the first ramp 510 of the movable block 5 and the second ramp 10 of the housing 1 so that the indication member 6 is exposed and visible from the window 401 of the limit knob 40.

After the limit knob 40 is again rotated by the lock core 41 to re-lock the locking portion 21 of the shackle 2, the movable block 5 is limited by the chamber 402 and the aperture 403 of the limit knob 40 so that the movable block 5 cannot be moved along with the driving member 404 of the limit knob 40 and still kept at the indication position, which indicates that the lock mechanism 4 has been operated. Additionally, when the number lock unit 3 is unlocked, the end 210 of the locking portion 21 of the shackle 2 can be used to press downward into the aperture 403 of the limit knob 40 so as to push the shaft 50 of the movable block 5 downward to make the movable block 5 pushed away from the indication position, namely to reset the indication member 6. Alternatively, the shackle 2 can be pulled outward and rotated away from the limit knob 40 so as to allow an insert (not shown) inserting into the aperture 403 of the limit knob 40 to push the shaft 50 of the movable block 5 downward to make the movable block 5 pushed away from the indication position.

Figure 11:
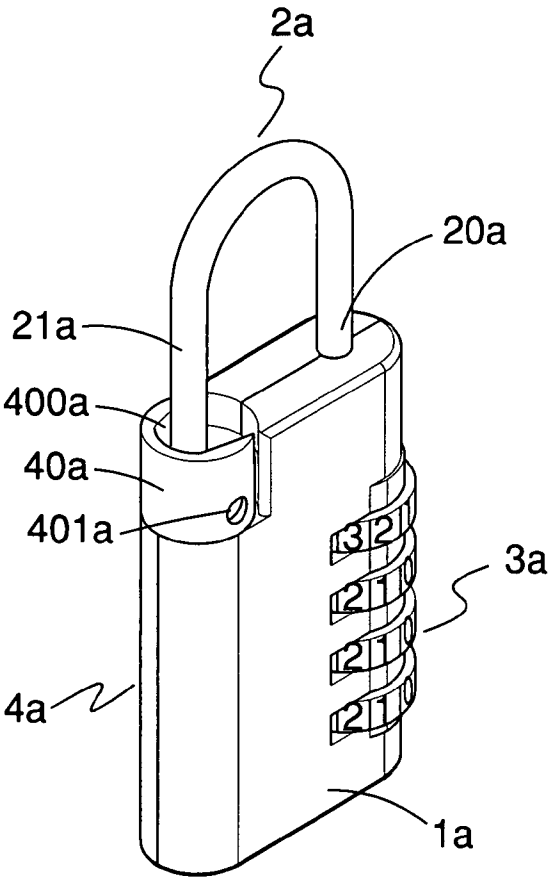
FIG. 11 is a perspective view of a padlock in accordance with a second embodiment of the present invention.

Referring to FIG. 11, a padlock in accordance with a second embodiment of the present invention includes a structure like that of the first embodiment.

Figure 12:
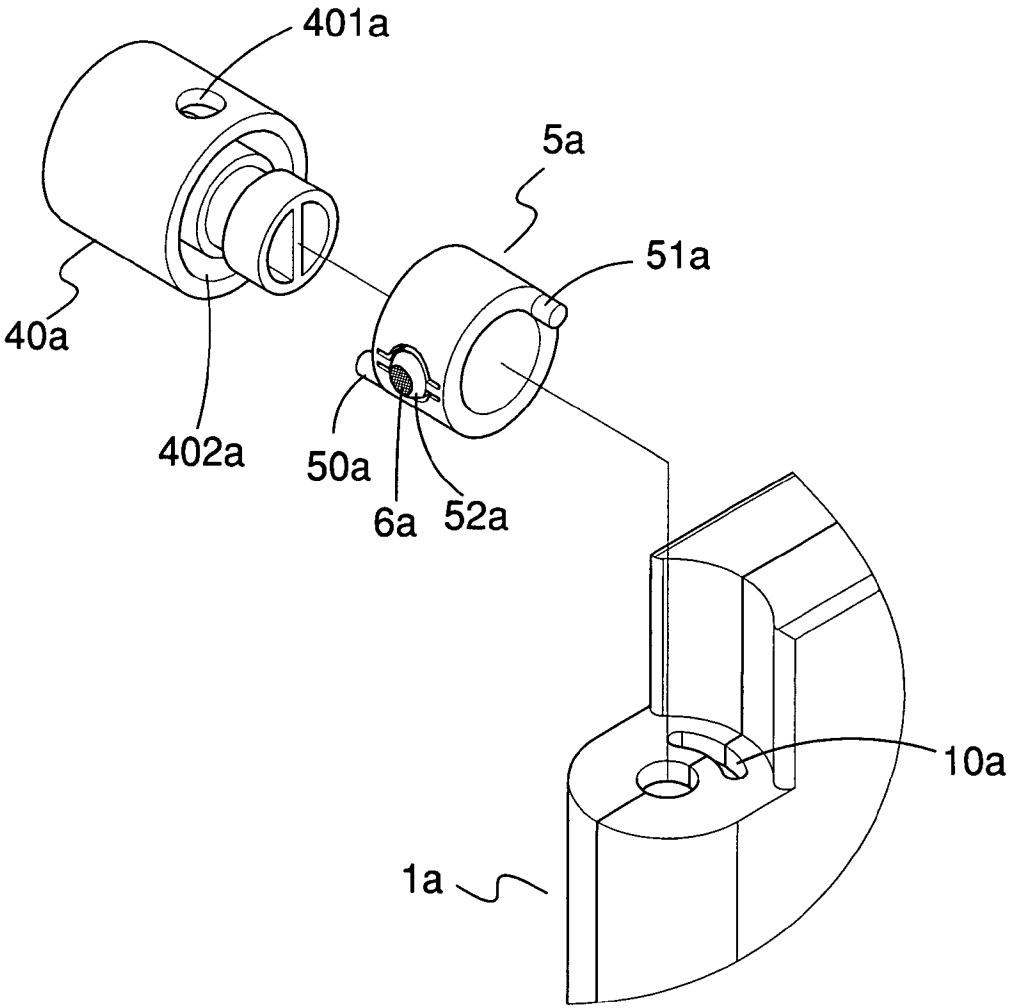
FIG. 12 is an exploded partial view of the padlock shown in FIG. 11.

Referring to FIG. 12, a housing 1*a* defines an arc-shaped slot 10*a*, and a movable block 5*a* includes a first side provided with a first post 50*a* and a second side provided with a second post 51*a* mounted in the slot 10*a* of the housing 1*a* in a sliding manner. The movable block 5*a* includes a periphery provided with an elastic protrusion 52*a* corresponding to the window 401*a* of the limit knob 40*a*, and the indication member 6*a* is mounted on the elastic protrusion 52*a*.

Figure 13:
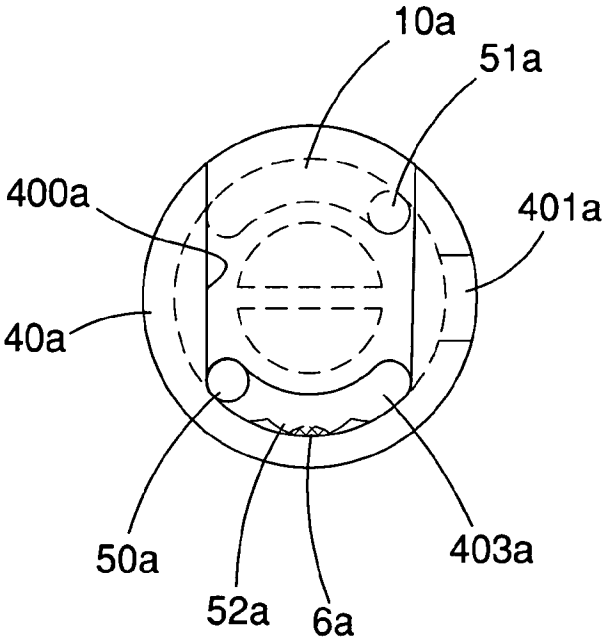
FIG. 13 is a top view of the padlock shown in FIG. 12.

Referring to FIG. 13, a recess 400*a* of a limit knob 40*a* defines an arc-shaped slot 403*a* in communication with a chamber 402*a*, and the first post 50*a* of a movable block 5*a* is mounted in the slot 403*a* of the limit knob 40*a* in a sliding manner.

Figure 14:
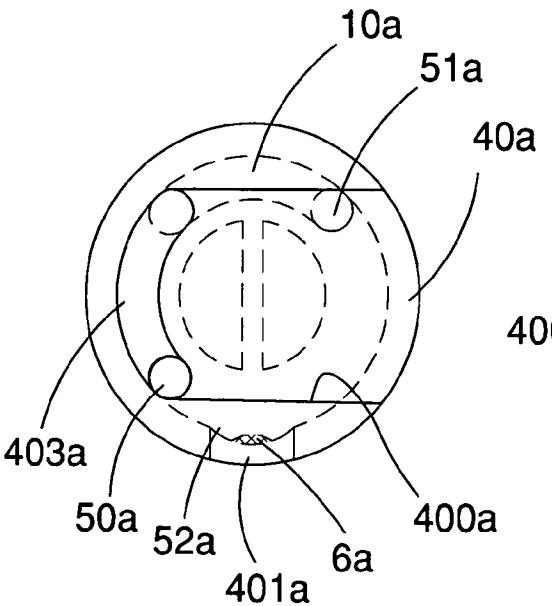
FIG. 14 is a top view of the padlock in another position than that is shown in FIG. 13.

Referring to FIG. 14, the limit knob 40*a* is rotated clockwise so that the recess 400*a* of the limit knob 40*a* is located at the opened or unlocked state. At the time, the second post 51*a* of the movable block Sa is limited by a terminal side of the slot 10*a* of the housing 1*a* so that the movable block Sa is not moved with the limit knob 40*a*, while a window 401*a* of the limit knob 40*a* is moved and to aligned with the elastic protrusion 52*a* so that the indication member 6*a* is exposed and visible from the window 401*a* of the limit knob 40*a*.

Figure 15:
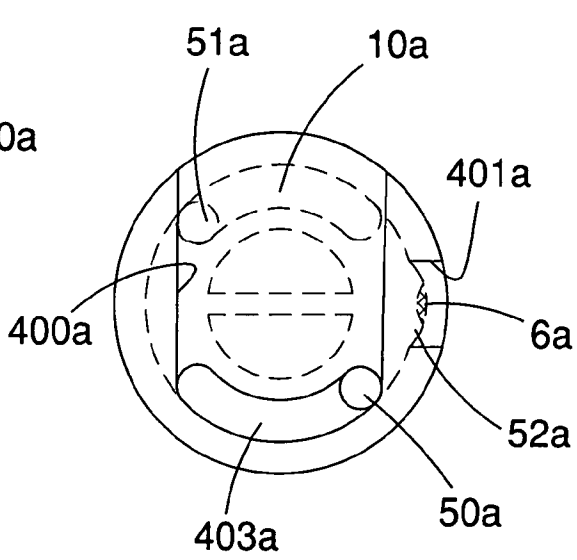
FIG. 15 is a top view of the padlock in another position than that is shown in FIG. 14.

Referring to FIG. 15, the limit knob 40*a* is rotated counterclockwise to the original position so that the recess 400*a* of the limit knob 40*a* is located at the closed or locked state. At this time, the elastic protrusion 52*a* is inserted into the window 401*a* of the limit knob 40*a* so that the movable block 5*a* is moved with the limit knob 40*a*, and the indication member 6*a* is still exposed from the window 401*a* of the limit knob 40*a*, which indicates that the lock mechanism 4*a* has been operated.

When the number lock unit 3*a* is unlocked, the shackle 2*a* is pulled outward and is rotate from the limit knob 40*a*. Then, a tool (not shown) can be inserted into the slot 403*a* of the limit knob 40*a* to cause the first post 50*a* of the movable block 5*a* to return to its original position so that the indication member 6*a* is detached from the window 401*a* of the limit knob 40*a* and is hidden in the limit knob 40*a*.

Figure 16:
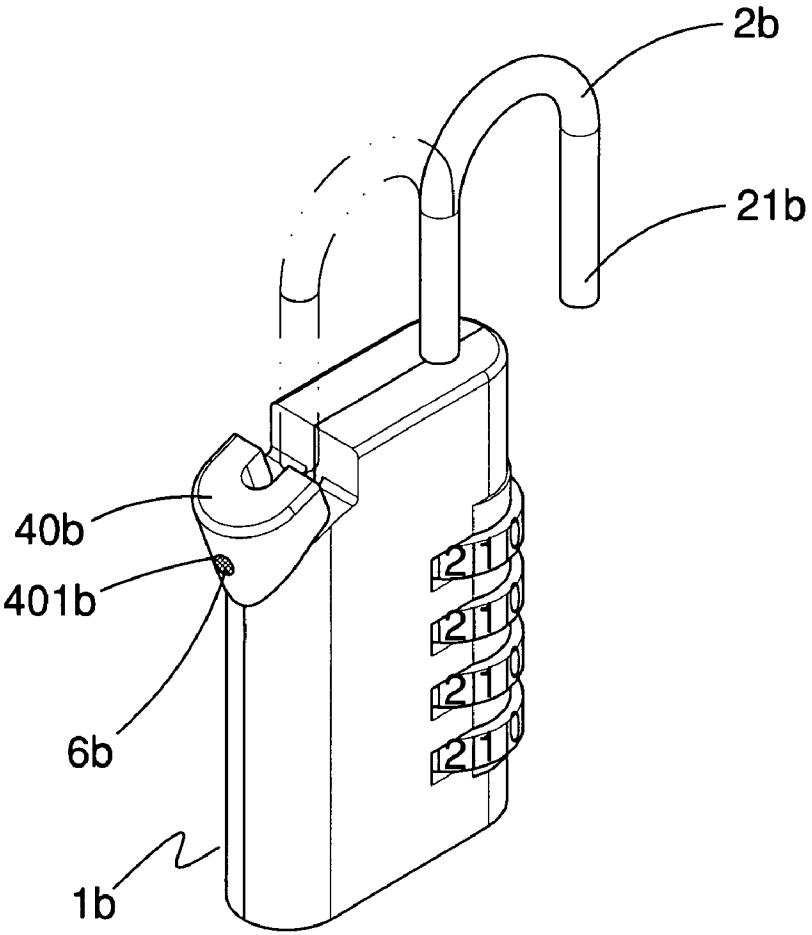
FIG. 16 is a perspective view of a padlock in accordance with a third embodiment of the present invention.

Referring to FIG. 16, a padlock in accordance with a third embodiment of the present invention includes a structure like that of the above embodiments. A limit knob 40*b* is pivotally mounted on an upper side of a housing 1*b* to limit a locking portion 21*b* of a shackle 2*b* so that the locking portion 21*b* of the shackle 2*b* is located at a locked state, or release the locking portion 21*b* of the shackle 2*b* so that the locking portion 21*b* of the shackle 2*b* is located at an unlocked state. When the locking portion 21*b* of the shackle 2*b* is located at the unlocked state, the indication member 6*b* is moved with the limit knob 40*b* and is visible from a window 401*b* of the limit knob 40*b*.

Figure 17:
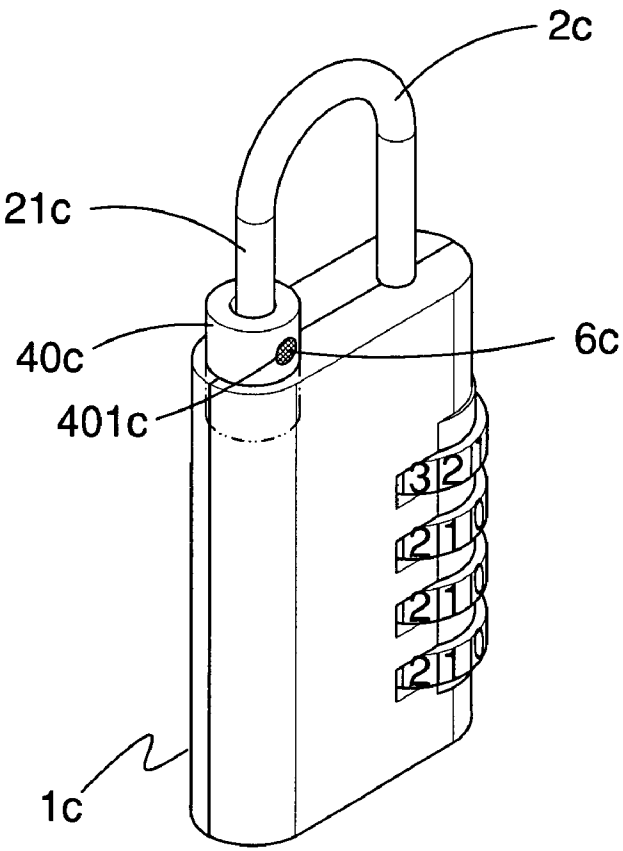
FIG. 17 is a perspective view of a padlock in accordance with a fourth embodiment of the present invention.

Referring to FIG. 17, a padlock in accordance with a fourth embodiment of the present invention includes a structure like that of the above embodiments. A limit knob 40*c* is retractably mounted on an upper side of a housing 1*c* to limit a locking portion 21*c* of a shackle 2*c* so that the locking portion 21*c* of the shackle 2*c* is located at a locked state, or release the locking portion 21*c* of the shackle 2*c* so that the locking portion 21*c* of the shackle 2*c* is located at an unlocked state. When the locking portion 21*c* of the shackle 2*c* is located at the unlocked state, the indication member 6*c* is moved with the limit knob 40*c* and exposed from a window 401*c* of the limit knob 40*c*.

Figure 19:
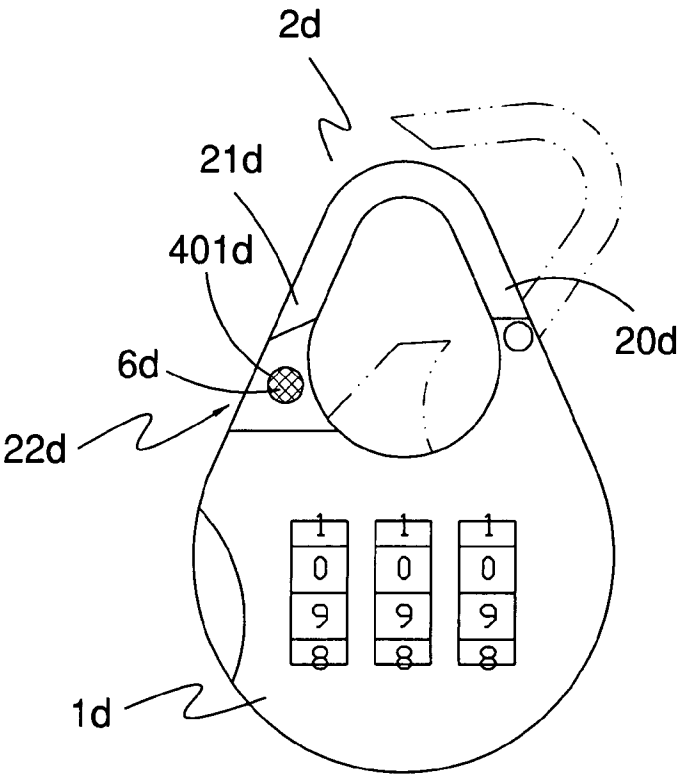
FIG. 19 is a front view of a padlock in accordance with a sixth embodiment of the present invention.
Figure 18:
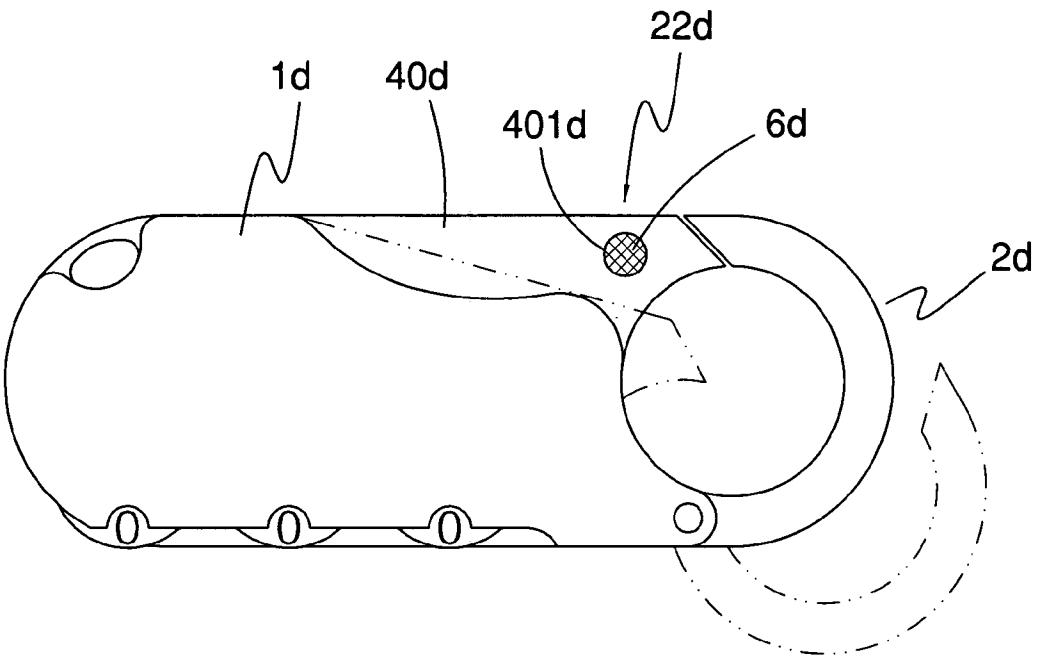
FIG. 18 is a front view of a padlock in accordance with a fifth embodiment of the present invention.

FIG. 18 shows a fifth embodiment of the present invention, and FIG. 19 shows a sixth embodiment of the present invention. Both embodiments respectively show a padlock includes a structure like that of the above embodiments. A shaft portion 20*d* of a shackle 2*d* is pivotally mounted on a side of a housing 1*d*, and a gap 22*d* is defined between an end of a locking portion 21*d* of a shackle 2*d* and the housing 1*d*. A limit knob 40*d* is pivotally mounted on the housing Id and inserted in the gap 22*d* to form a locked state. As the limit knob 40*d* is pressed towards the housing 1*d*, the gap 22*d* is opened to form an unlocked state so that the indication member 6*d* is moved with the limit knob 40*d* and exposed from a window 401*d* of the limit knob 40*d*.

Figure 20:
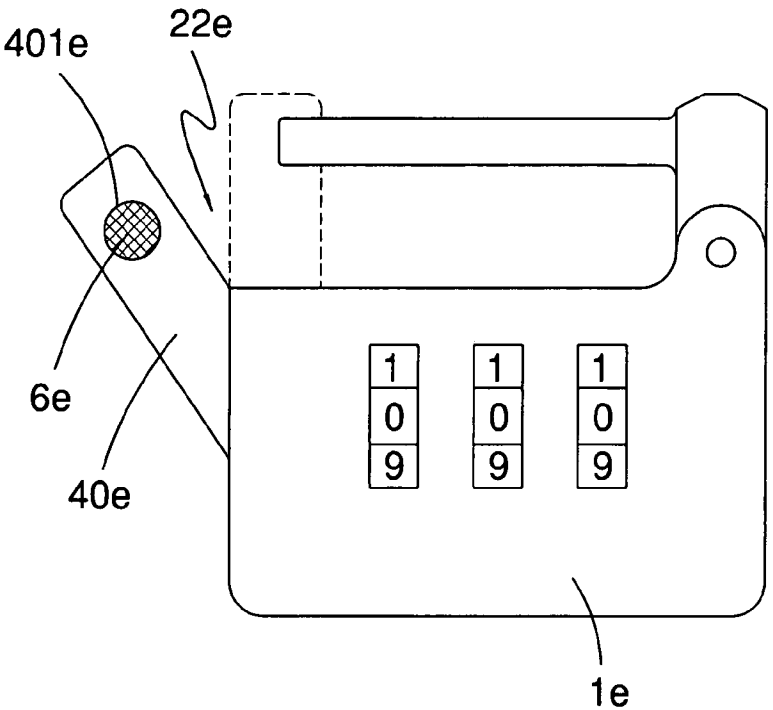
FIG. 20 is a front view of a padlock in accordance with a seventh embodiment of the present invention.

Referring to FIG. 20, a padlock in accordance with a seventh embodiment of the present invention includes a structure like that of the above embodiments. A limit knob 40*e* is pivotally mounted on the housing 1*e* and inserted in a gap 22*e* to form a locked state. When the limit knob 40*e* is moved outward relative to the housing 1*e*, the gap 22*e* is opened to form an unlocked state so that the indication member 6*e* is moved with the limit knob 40*e* and exposed from a window 401*e* of the limit knob 40*e*.

Figure 21:
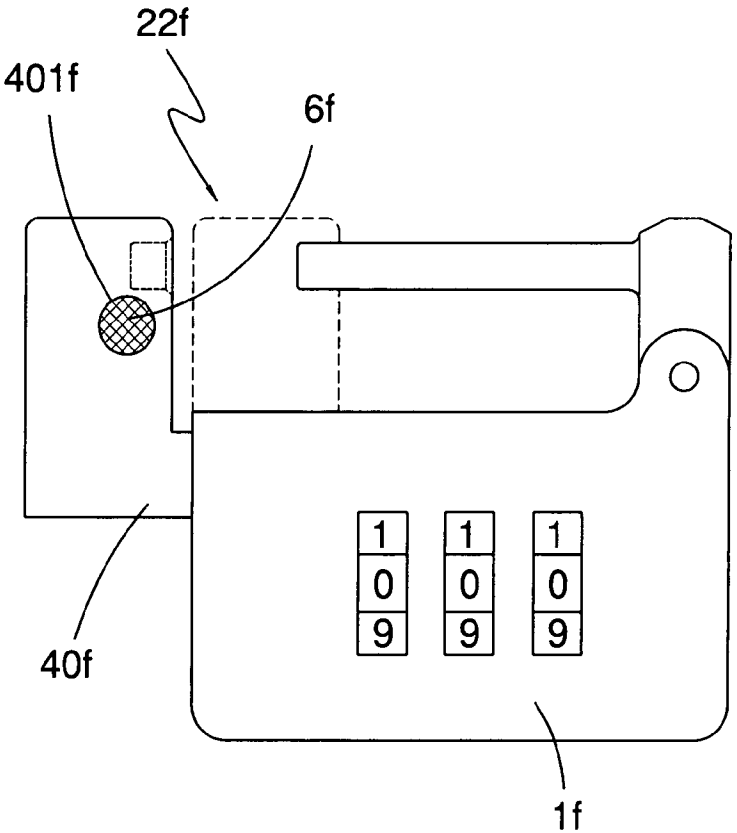
FIG. 21 is a front view of a padlock in accordance with an eighth embodiment of the present invention.

Referring to FIG. 21, a padlock in accordance with an eighth embodiment of the present invention includes a structure like that of the above embodiments. A limit knob 40*f* is linearly and movably mounted on a housing if and inserted in a gap 22*f* to form a locked state. As the limit knob 40*f* is linearly moved outward relative to the housing If, the gap 22*f* is opened to form an unlocked state so that an indication member 6*f* is moved with the limit knob 40*f* and exposed from a window 401*f* of the limit knob 40*f*.

Figure 23:
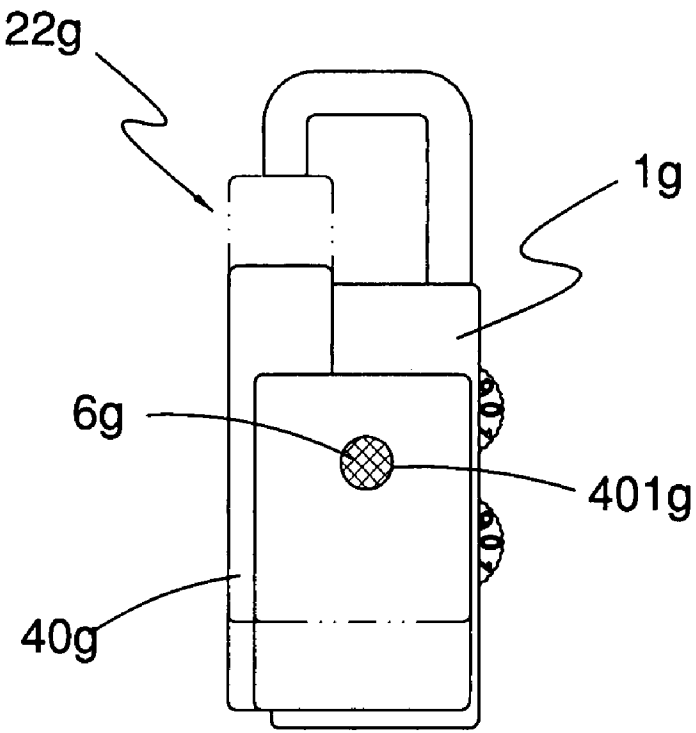
FIG. 23 is a front view of the padlock shown in FIG. 22.
Figure 22:
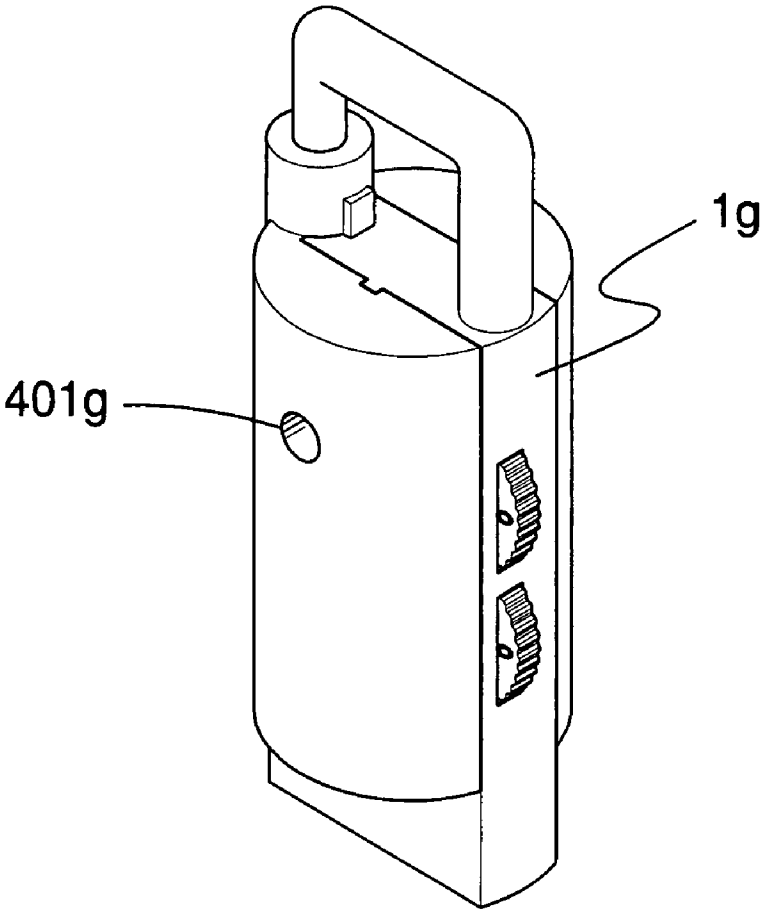
FIG. 22 is a perspective view of a padlock in accordance with a ninth embodiment of the present invention.

Referring to FIGS. 22 and 23, a padlock in accordance with a ninth embodiment of the present invention includes a structure like that of the above embodiments. A limit knob 40*g* is partially extended from a side of a housing 1*g* and is longitudinally movable on the housing 1*g* to open a gap 22*g* so as to form an unlocked state so that an indication member 6*g* is moved with the limit knob 40*g* and exposed from a window 401*g* of the limit knob 40*g*.

Figure 24:
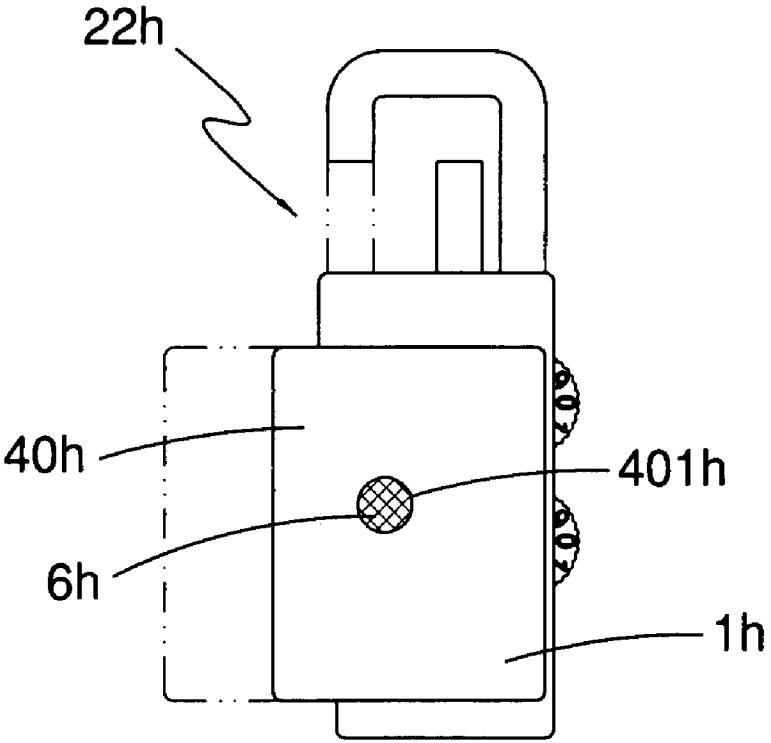
FIG. 24 is a front view of a padlock in accordance with a tenth embodiment of the present invention.

Referring to FIG. 24, a padlock in accordance with a tenth embodiment of the present invention includes a structure like that of the above embodiments. A limit knob 40*h* is transversely movable on a housing 1*h* to open a gap 22*h* so as to form an unlocked state so that an indication member 6*h* is moved with the limit knob 40*h* and exposed from a window 401*h* of the limit knob 40*h*.

Figure 25:
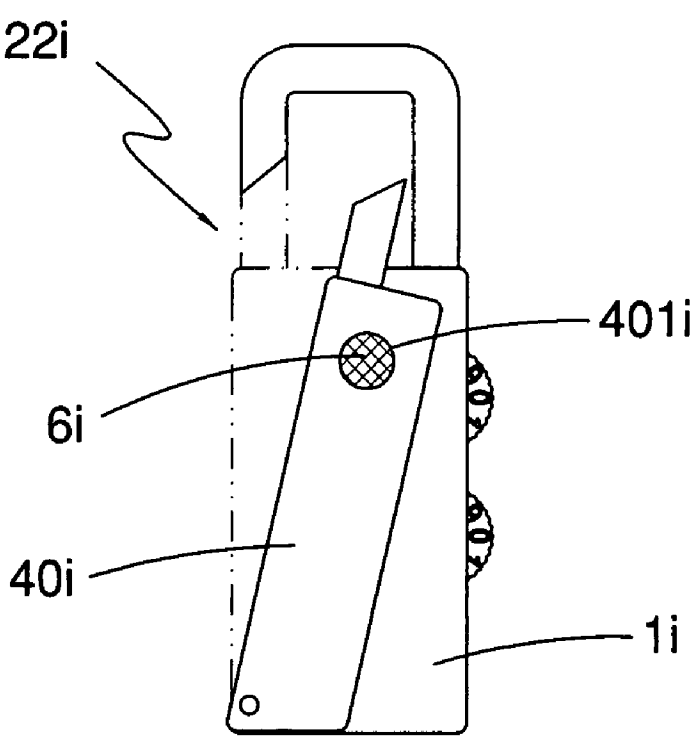
FIG. 25 is a front view of a padlock in accordance with an eleventh embodiment of the present invention.

Referring to FIG. 25, a padlock in accordance with an eleventh embodiment of the present invention includes a structure like that of the above embodiments. A limit knob 40*i* includes an end pivotally mounted on a bottom of a housing 1*i*. Thus, the limit knob 40*i* is pivoted on the housing 1*i* to open a gap 22*i* so as to form an unlocked state so that an indication member 6*i* is moved with the limit knob 40*i* and exposed from a window 401*i* of the limit knob 40*i*.

After a customs inspector has unlocked the padlock for checking the luggage, case or bag, the indication member is exposed and visible from the window of the limit knob for reminding a padlock owner whose padlock has been operated or used and luggage may have been inspected by the customs inspector. In addition, the padlock owner can directly and easily judge if the customs inspector has operated or used the padlock for checking the luggage. Furthermore, in the present invention, the movable block can be moved to the indication position not only by using the matching key to operate the lock core of the lock mechanism as above described, but also by any object which can reach or access to the lock core of the lock mechanism, especially the object which can reach or access to the movable block via the lock core, so as to further remind the padlock owner that the lock mechanism of the padlock has been used or touched.

In the foregoing embodiments, the movable block is mounted in the limit knob. However, in another embodiment or application, the movable block can be mounted outside the limit knob entirely or partially, and the window of the limit knob can be omitted. In the foregoing embodiments, the movable block can be moved in a rectilinear manner, i.e., lifted and lowered. In another embodiment or application, the movable block can however be moved in an angular manner, i.e., pivoted. In the foregoing embodiments, the lock core of the lock mechanism can include a first member non-movably mounted in the housing of the padlock, and a second member movably mounted in the first member and can be rotated by the matching key. However, in another embodiment, the lock core of the lock mechanism can be a one-piece element movably mounted in the housing of the padlock and can be rotated by the matching key.

Although the invention has been explained in relation to the foregoing embodiments, it is to be understood that many modifications and variations can be made without departing from the scope of the present invention. It is contemplated that the appended claim or claims will cover such modifications and variations that fall within the true scope of the invention.

The invention claimed is:

1. A padlock comprising:

a housing defining an opening in a wall thereof to communicate an interior space of the housing and the outside of the housing;

a shackle mounted on the housing and having a first end formed with a shaft portion movably mounted in the housing, and a second end formed with a locking portion moved with the shaft portion, extended from the shaft portion and located outside the housing;

a lock mechanism mounted on the housing and including: a lock core positioned in the housing; and a limit knob having a driving member and a button, the driving member being partly received in the housing via the opening and having one end connected with the button and the other end connected with the lock core, the button being positioned outside the housing, wherein the driving member is capable of being rotated by the lock core so as to drive the button to move to a first position where the locking portion of the shackle is confined in the button and a second position where the locking portion is released from the button; and a movable block disposed on the driving member of the limit knob;

wherein the movable block moves along the driving member to a predetermined position outside of the housing when the limit knob is rotated by the lock core to have the button move from the first position to the second position; and the movable block is kept at the predetermined position when the limit knob is again rotated by the lock core to have the button move from the second position back to the first position.

2. The padlock of claim 1, wherein the button of the limit knob defines a window and a chamber for receiving the movable block, and the movable block defines an identification area thereon which is visible from the window when the movable block is displaced to the indication predetermined position.

3. The padlock of claim 1, wherein the lock core of the lock mechanism comprises a body and a rotor received in the body, and wherein the rotor has one end defining a keyhole, and the other end defining a driving portion extending from the body and connecting with the driving member of the limit knob.

4. The padlock of claim 1, further comprising a number lock core positioned in the housing to control axial movement of the shaft portion of the shackle.

5. The padlock of claim 3, wherein the button of the limit knob defines a window and a chamber for receiving the movable block, and the movable block defines an identification area thereon which is visible from the window when the movable block is displaced to the predetermined position.

6. The padlock of claim 1, wherein the button of the limit knob is rotatable and defines a recess therein to receive the locking portion of the shackle in order to control rotation of the locking portion about the shaft portion of the shackle.

7. The padlock of claim 6, wherein the recess includes an open end at a periphery of the button.

8. The padlock of claim 2, wherein the button of the limit knob defines an aperture communicated with the chamber such that the movable block can be pushed back to an original position by an insert via the aperture; and the aperture is hidden by the locking portion of the shackle when the button and the locking portion are coupled.

9. The padlock of claim 7, wherein the button of the limit knob defines a chamber therein to receive the movable block and an aperture in a surface thereof and in communication with the chamber such that the movable block can be pushed back to an original position by an insert via the aperture; and the aperture is hidden by the locking portion of the shackle when the button and the locking portion are coupled.

* * * * *